United States Patent [19]

Clark

[11] Patent Number: 4,738,563

[45] Date of Patent: Apr. 19, 1988

[54] BUOYANT MARINE FENCE

[76] Inventor: Stephen E. Clark, 1344 Monterey Ave., Norfolk, Va. 23508

[21] Appl. No.: 77,117

[22] Filed: Jul. 22, 1987

[51] Int. Cl.[4] ..... E02B 3/00

[52] U.S. Cl. ..... 405/52; 256/23; 405/21; 405/63

[58] Field of Search ..... 405/52, 63–70, 405/21–26, 15–17, 30–35; 256/1, 23

[56] References Cited

U.S. PATENT DOCUMENTS

| | | | |
|---|---|---|---|
| 2,367,997 | 1/1945 | Chambers | 405/63 X |
| 2,391,059 | 12/1945 | MacFarren | 405/52 X |
| 3,456,265 | 7/1969 | Carnahan | 405/67 X |
| 3,691,773 | 9/1972 | Ruhlman | 405/70 |
| 3,758,083 | 9/1973 | Palmer | 405/52 X |
| 3,984,987 | 10/1976 | Light | 405/63 |
| 4,097,025 | 6/1978 | Dettmann et al. | 256/1 |
| 4,201,495 | 5/1980 | Preus | 405/63 |
| 4,248,547 | 2/1981 | Brown | 405/67 |
| 4,252,461 | 2/1981 | Colamussi et al. | 405/64 X |

FOREIGN PATENT DOCUMENTS

| | | | |
|---|---|---|---|
| 2552133 | 3/1985 | France | 405/63 |
| 548446 | 9/1956 | Italy | 256/23 |
| 0044011 | 3/1982 | Japan | 405/26 |
| 0175616 | 9/1985 | Japan | 405/52 |

*Primary Examiner*—Dennis L. Taylor

[57] ABSTRACT

Partially submerged, buoyant portable marine fence has netting material attached to series of float-supported longitudinally spaced upright fence poles which extend from bottom of water to above the surface of water. Floats are attached to each pole at the low water elevation on each pole. When horizontal wind or water forces are exerted upon fence, poles pivot about detachable ballasts located at the base of each pole.

11 Claims, 3 Drawing Sheets

BUOYANT MARINE FENCE

FIELD OF INVENTION

The present invention relates to marine nets and fences and more particularly to a marine fence adapted to be disposed in substantially an upright position in water and having a submerged lower portion and an upper portion extending substantially above the water supported by float-buoyed fence poles.

BACKGROUND AND PRIOR ART

It is a well known condition that many recreational swimming areas are underutilized because such waters are often occupied by various forms of sea animals which are perceived as jeopardizing the safety of would-be swimmers.

Prior means including sonic signals, electrical charges and chemical deterrants have been employed to discourage marine animals from occupying human swimming areas. Another common means to exclude marine animals from bathing areas involves various forms of physical barriers, particularly fences and nets, which encircle such swimming areas. Prior marine nets and fences are typically supported by either (1) a series of permanently positioned rigid vertical fence poles, or (2) as series of floats connected to the top of the nets floating at the surface of the water.

A problem of prior devices which use permanent rigid fence poles is that such nets cannot be easily relocated. It is also a problem that installation of permanent poles is a difficult and costly operation. Also, since the location of the fence is, by its nature, fixed in the water, it is often difficult to make repairs to such devices. Another problem of fixed position fences is that they generally must be oversized so as to allow for wide ranges of water levels, particularly in waters subject to current and tide variations. Another problem of fixed rigid poles is that in order to remain erect they must be constructed and installed with sufficient structural strength to overcome extremes of forces exerted thereupon by wind, tide, waves and debris.

Prior devices which comprise nets supported by floats on the surface of the water either sink under their own weight so that the top of the net is below the surface, or lift up from the bottom of the water so that the bottom of the net is above the floor of waterway, when the depth of the water increases as occurs with an incoming tide. Similarly, with an outgoing tide, such prior devices develop superfulous slack in the net in which swimmers may become entangled. Another problem of such prior devices is that all of the net is at all times underwater, and it is therefore not visible to swimmers—thereby providing an unobservable underwater hazard to swimmers.

It is also a problem of such prior devices that a continuous, or nearly continuous, float system, or "boom", is usually required in order to support the net. A problem which is inherent in floating booms is that tidal drag exerted on them is often very high and results in large forces exerted upon anchoring devices at the end of such booms.

OBJECTS

Accordingly, it is a primary objective of the present invention to provide a novel construction of a marine fence having a partially submerged net suspended by float-supported relocatable poles.

It is another object of the present invention to provide a device of the character described which can be easily installed in, and removed from, water.

It is another object of the present invention to provide a device of the character described which can be readily relocated in water to accommodate changing conditions of tides.

It is another object of the present invention to provide a device of the character described in which said poles tilt when increased horizontal forces are exerted thereupon so as to relieve stresses resulting from waves, wind, current and floating debris against the device.

It is another object of the present invention to provide a device of the character described in which said poles remain disposed in a substantally upright position over a varying range of tidal depths.

It is another object of the present invention to provide a device of the character described in which said poles may flex relative to one another.

Further objects and advantages of this invention will become apparent from a consideration of the drawings and ensuing description thereof.

DRAWINGS

DESCRIPTION

Figure 1:
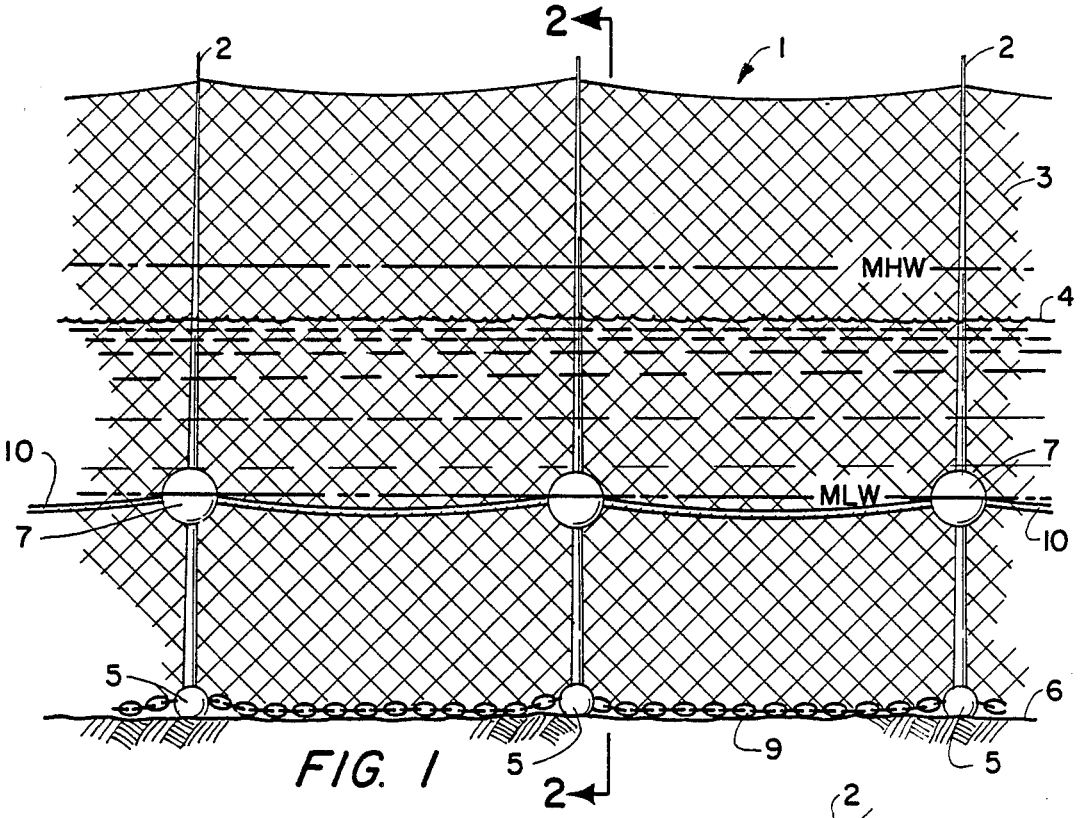
FIG. 1 is a perspective view of the present invention.
Figure 2:
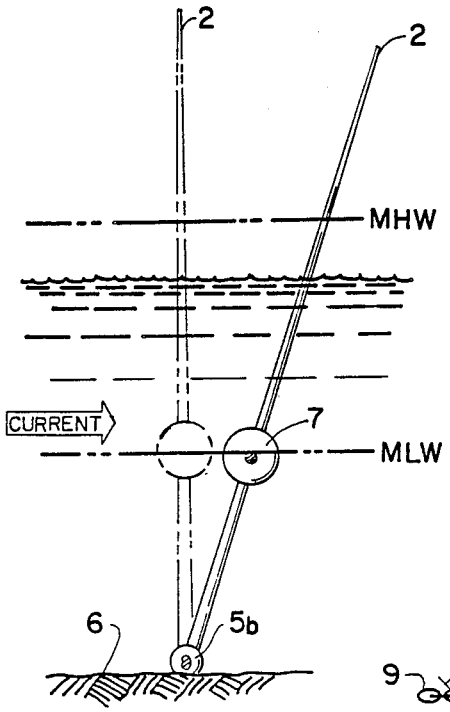
FIG. 2 is a cross-sectional view of the present invention taken along the line 2—2 of FIG. 1.

Referring to FIGS. 1 and 2: The present invention is a buoyant marine fence which in its entirety is generally designated (1).

In many natural waterways, the elevation of the surface of the water (4) varies due, for example, to lunar tidal effects, precipitation or wind, between a low water elevation and a high water elevation. Low water and high water elevations are designated "MLW" and "MHW" respectively in the figures.

The preferred embodiment of the invention comprises a flexible net (3) attached to, and extending between, a plurality of longitudinally spaced, nominally upright, poles (2). Poles (2) are preferably of circular cross section and taper from large to relatively smaller diameter from bottom to top of the poles, respectfully. Poles (2) preferably are constructed of lightweight, flexible, non-corrosive material such as plastic or nylon, and provide support to net (3).

Floats (7) are attached to each pole (2) at a distance from the base of each pole generally corresponding to the low water elevation (MLW), such that when the fence (1) is in use, floats (7) will always be at or below the surface of the water (4). The construction of float (7) is such that it has sufficient buoyancy to maintain pole (2) in a substantially upright orientation.

In the preferred embodiment of the invention, floats (2) are circular in cross section to minimize drag forces exerted thereagainst by water current and wind. However, floats (2) in practice may also be made of any non-circular shape.

Ballast weights (5) are attached to the bottom of each pole (2) and are of sufficient weight to hold the bottom of each pole (2) to the ground (6). The weight of ballast (5) must, accordingly, exceed the buoyant force of float (7) which tends to lift pole (2) away from the ground (6). Although any shape of ballast may be used, including weights within the base of the poles (2), two particular ballast shapes offer specific advantages to the present invention. One ballast configuration (5*a*), shown in FIG. 3, comprises a low profile wide based ballast which has a low center of gravity. This ballast (5*a*) configuration has high stability characteristics and offers maximum resistance to horizontal wind and tidal forces exerted upon pole (2) which tend to tip pole and ballast (5*a*) over. Another advantage of this ballast construction is that poles (2) which are secured thereto may remain in a generally upright orientation even when float (7) is temporarily above the surface of the water (4) as may occur, for example, during an exceptionally low tide or during fence (1) installation or removal from water.

A second ballast configuration (5*b*) is shown in FIG. 2. Spherical ballasts (5*b*) are advantageous in that they have no inherently preferred orientation (i.e. they are symmetric in all axes), and accordingly offer little resistance to tipping of pole (2) which is attached thereto when horizontal tidal and wind forces are exerted upon pole. Such sperical ballasts (5*b*) therefore permit pole (2) to tilt, or "give" with tidal forces, and reduce shear stress in pole (2).

Figure 3:
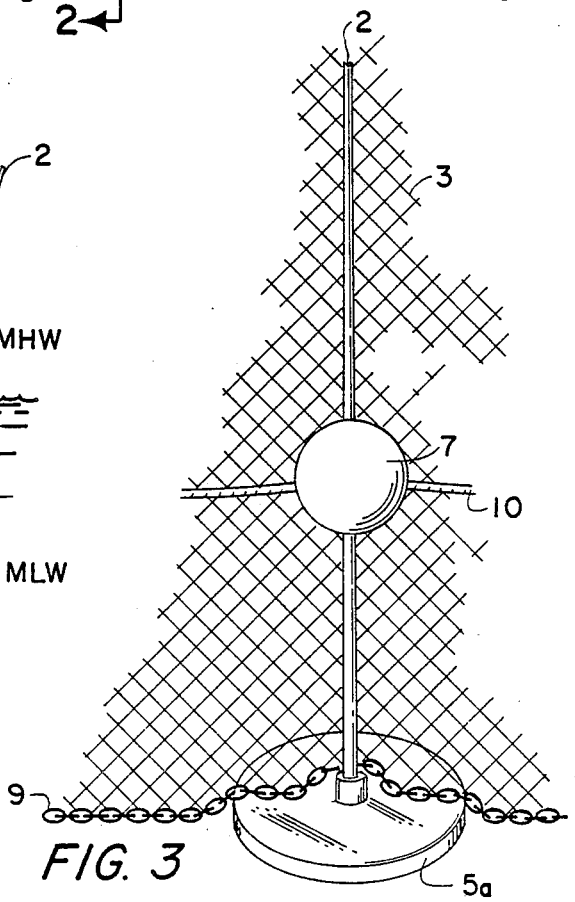
FIG. 3 is a perspective view showing low-profile wide base ballast construction.
Figure 4:
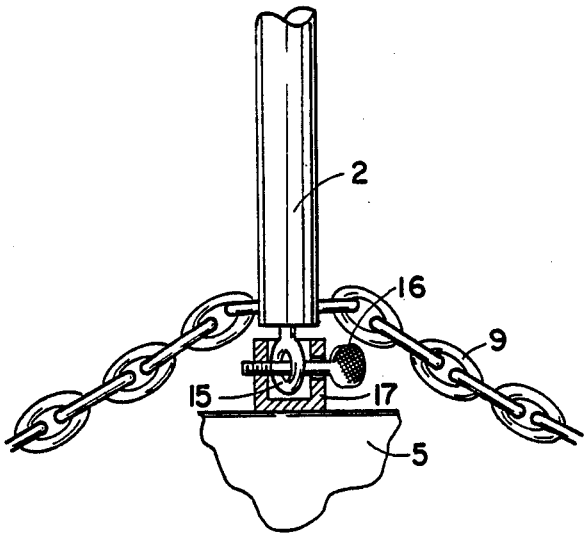
FIG. 4 is a perspective view showing ballast swivel construction.

Chain (9) is provided at bottom of net (3) and is attached to base of each pole from end to end of the fence (1). Chain (9) provides a means for securing the various poles (2) of the fence (1) to each other; helps hold bottom of net (3) at or near ground (6); and helps locate base of poles (2) at predetermined spacing from each other. It will be appreciated that although a chain (9) is used in the preferred embodiment of the invention, a cord, cable or wire rope or other such common connecting means may be used in its place. Also, although in the preferred embodiment of the invention chain (9) is connected to ballast (5) as is shown in FIGS. 1 and 2, it may also be directly connected to the base of poles (2) as shown in FIGS. 3 and 4.

Cable (10) extends from one end of the fence (1) to the other and is connected to each pole (2) at an intermediate point along each pole, preferably at the low water elevation (MLW). Cable (10) serves as a means to facilitate pulling the fence (1) in and out of the water and further helps to maintain, within predetermined limits, equal spacing between the mid-points of adjacent poles.

Figure 7:
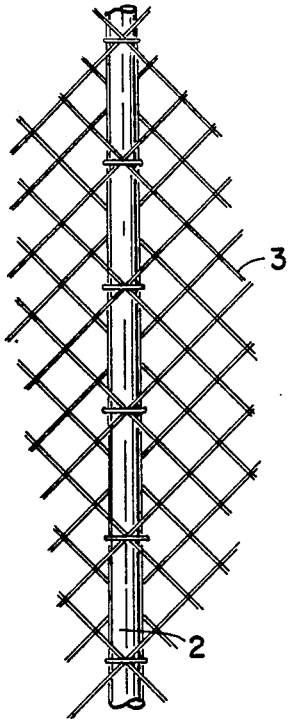
FIG. 7 is a perspective view showing pole woven through net.
Figure 8:
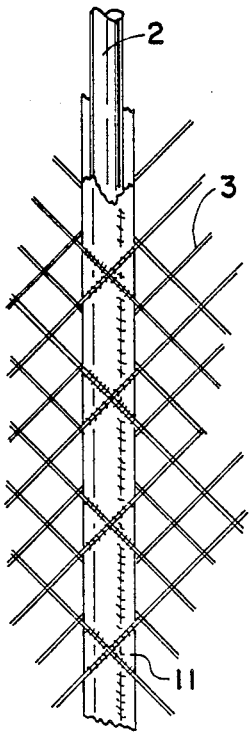
FIG. 8 is a perspective view showing pole inserted in sheave, woven through net.

Net (3) extends approximately from the ground (6) vertically to an elevation a finite distance on poles (2) above floats (7), preferably above the high water elevation (MHW) as shown in FIGS. 1 and 2. Net (3) is supported by poles (2) to which it is attached. In the preferred embodiment of the invention, net (3) is continuously attached to poles (2) from the bottom of the net to the top of the net by "threading" the pole (2) through the meshing of the net (3) and securing net to poles, for example by tying at frequent intervals as shown in FIG. 7, which serves to reduce excessive stresses at the individual cords of the net such as may occur if the net were only attached to poles (2) at a few points along the poles. Wear and abrasion of net (3) by rubbing against poles (2) may be further reduced by inserting poles (2) into sheave (11) and sewing sheave to net (3) as shown in FIG. 8.

OPERATION

Referring to FIGS. 1 and 2: When used in still water (i.e. no current or waves) and still air (i.e. no wind), floats (7) have sufficient buoyancy in water (4) to hold poles (2) in particular and therefore the entire fence (1) in general, in an upright position. Ballasts (5) hold the base of each ple (2) on the ground (6). Chain (9) holds bottom of net (3) at or near ground (6) and net extends to a finite elevation above the high water mark (MHW). As the elevation of the surface of the water (4) varies between the low water (MLW) and high water (MHW) elevations, float (7) is at all times at or below the surface of the water and maintains sufficient buoyancy to hold pole (2) in an upright position.

The top of net (3) is seen then always to be above the surface of the water (4).

It will be appreciated from the above that the device thus described effects a continuous net fence from the ground (6) to above the surface of the water (4), and that a portion of the fence (1) is always visible from above the surface of the water. It will also be appreciated by those skilled in the art that, due to the fact that the base of poles (2) are held in place by ballasts (5) rather than, for example, by anchoring or otherwise permanently setting poles in the ground, the present invention can be moved from one site to another when so desired without difficulty.

Such relocating of the fence (1) is most easily effected by pulling the device by chain (9) and cable (10) which extend beyond the ends of the device.

The force required to pull the device during a relocating operation in the manner described above can be significantly reduced by reducing the weight of the device. Accordingly, in the preferred embodiment of the invention, ballasts (5) are attached to poles (2) by temporary connection, whereby ballasts may readily be removed from poles (2). Two methods for temporarily attaching ballasts (5) to poles (2) are shown in FIGS. 4–6, but many common means of temporary fasteners may be used in this place.

Referring to FIG. 4: Pole (2) has an eye (15) at its bottom which loosely fits around threaded screw (16). Screw (16) is attached to clevis (17). Clevis (17) is attached to ballast (5) by any standard means of fastening (such as screws or welding), or may be formed as a continuous member of ballast (5). It will be appreciated that pole (2) can swivel about screw (16) while ballast (5) remains in a fixed position.

Figure 5:
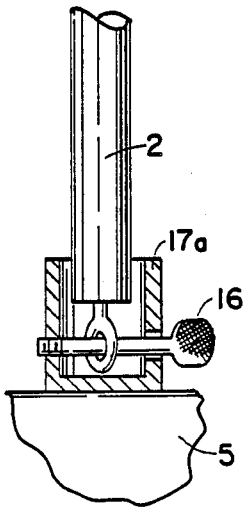
FIG. 5 is a perspective view showing a modified ballast swivel construction with net pole in upright position.
Figure 6:
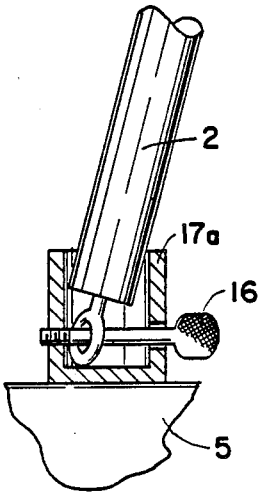
FIG. 6 is a perspective view similar to FIG. 5 but with net pole in tilted position.

A variation of the swivel mounting construction of FIG. 4 is shown in FIGS. 5 and 6. The swivel construction shown in FIG. 5 is similar to that shown in FIG. 4 except that clevis (17*a*) extends above and around the bottom of pole (2). As shown in FIG. 6, pole (2) may swivel freely about screw until pole (2) touches clevis (17*a*). Further tilting of pole (2) beyond the position shown in FIG. 6 cannot be effected without also tilting ballast. It will be apreciated that the swivel construction shown in FIGS. 5 and 6 permits unobstructed tilting of pole (2) within limits noted, but that when removed from water, pole can remain in supported (tilted) position.

It will be appreciated that with ballast (5) removed from a section of the fence (1), that section of the net may be easily lifted, or even floated, off of the ground (6) which facilitates cleaning of the bottom of the net (3) and allows for a temporary opening between the bottom of the net (3) and the ground (6) through which unwanted debris may be passed. Screw (16), shown in FIGS. 4–6, may be removed to disconnect ballasts (5) from the rest of fence (1).

Referring to FIGS. 1 and 2: In moving water (i.e. current or waves), or in wind, horizontal forces exerted against the net (3), poles (2), floats (7) and cable (10) apply a torque about the base of poles (2) which tends to tip the fence (1) over. This torque is counteracted by the buoyant force of float (7) which tends to hold poles (7) upright. The more tilted the poles (2) become (i.e. the farther from vertical), the greater the counterbalancing torque that is applied by the buoyant force of floats (7), until the poles (2) naturally settle at a tilted orientation at which these two described torques exactly offset each other.

This tilting of poles (2) may be more easily effected by providing a spherical ballast (5*b*) at the base of pole (2) as shown in FIG. 2 or by attaching the base of pole (2) to ballast (5) by means of a swivel fastener, as shown in FIGS. 4–6, whereby tilting of pole (2) is not impeded by a rigid upright connection at the base of the pole.

It will be appreciated by those skilled in the art that the above described tilting of the poles (2), and accordingly of the fence (1) in general, which occurs as a result of tidal and wind forces against the fence, effectively reduces bending moments and shear forces along pole (2) which would otherwise be encountered if the poles were rigidly positioned in an upright orientation.

It will further be appreciated that in the event of severe wind or current conditions, the fence (1) will relieve stresses upon itself by tilting over. Under normal conditions, (i.e. none-severe weather conditions), the length of poles (2) and net (3) are long enough that the top of the poles and net remain above the surface of the water (4) when the net tilts as described above.

As a consequence of this reduction of bending moments and shear forces in poles (2), the structural requirements of the poles (2) are reduced accordingly, permitting the use of relatively lighter weight and smaller diameter poles than would otherwise be required if the poles were not allowed to so tilt.

It will also be appreciated that, because the tilting of one pole does not cause or require the tilting of the adjacent poles, tidal stresses on any isolated section or sections of fence (1) may be relieved by the tilting action described above. In this manner, stresses upon subsequent poles may be relieved in sequence as a wave passes longitudinally through the fence, thereby not causing the forces of such a wave to affect the entire length of the fence (1) at any instant.

Although both rigid and flexible poles (2) may be used, in the preferred embodiment of the invention, poles (2) made of flexible materials such as platic or nylon are used, as such flexible poles bend with the wind and water current and, therefore, even further reduce the bending stresses along the poles.

It will be appreciated that, because the fence (1) can be tilted, cleaning of net or removal of debris from one side of the net to the other may be accomplished by manually applying sufficient force to a section of the fence (1) to cause top of net (3) to tilt to below the surface of the water (4), thereby allowing debris to float over and away from it.

In the preferred embodiment of the invention, floats (7) are attached to poles (2) at or near the low water elevation (MLW). It is noted that this elevation (MLW) is the highest elevation at which float (7) is always in the water (4), and is therefore the highest elevation at which float can always provide buoyancy to hold up the poles (2). Additionally, it is noted that moving the float (7) closer to the bottom of the pole effectively reduces the counterbalancing torque that the float applies when the pole (2) becomes tilted as described above. Another advantage to locating the float (7) so that it is always in the water is that it is not subjected to forces exerted, for example, by breaking waves or debris floating at or above the surface, such as would be encountered if the float were positioned above the low water elevation (MLW).

Figure 9:
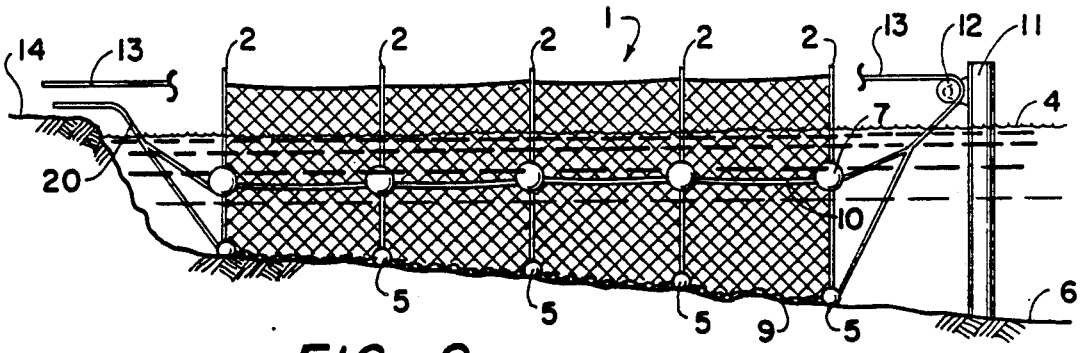
FIG. 9 is a perspective view of the present invention showing cables for moving net inward and outward.

Referring to FIG. 9: As discussed above, the present invention is a partially submerged marine fence which can be relocated from one area to another while remaining fully or substantially asssembled. One important modification of the present invention comprises a fixed anchor, piling, buoy or other similar permanent structure (11) having a pulley (12) or similar common apparatus having an eye through which a return cable (13) connected to one end of either cable (10) or chain (9), or both, may pass. Return cable (13) extends from pulley (12) to shore (14). By pulling return cable (13) through pulley (12), fence (1) can be deployed in water (4) from an onshore location. In a reverse manner, (i.e. by pulling the shoreward end of chain (9), cable (10), or extensions (2) thereof), the fence (1) can be pulled into shore. It will be appreciated that the location of the net may be controlled, as described above, from onshore. Accordingly, in times of unusually high or unusually low tides, the fence (1) can be brought into or away from shore, respectively, to accommodate the prevailing water elevations.

While the above description contains many specificities, these should not be construed as limitations on the scope of the invention, but rather as an exemplification of one preferred embodiment thereof. Many variations are possible, for example, ballasts (5) and chain (9) may be a single chain of sufficient ballast weight to hold down poles (2); additional floats (7) may be provided at various locations on poles (2); pole (2) may be of specific gravity less than one; net (3) may be a fabric, screen or other perforated flexible material; float (7) may be detachable from pole (2). Accordingly, the scope of the invention should be determined not by the embodiment illustrated, but by the appended claims and their legal equivalents.

I claim:

1. A marine fence comprising:

a plurality of longitudinally spaced fence posts including intermediate and end fence posts; each of said fence posts having an upper end and a bottom end;

a flexible mesh material extending from end to end of the fence and connected to each of said fence posts;

a float attached intermediately along the length of each of said fence posts;

each of said fence posts having a ballast weight disposed near the bottom end of said fence posts by which means the bottom of said fence post sinks in water;

a float disposed intermediately along the length of each of said fence posts by which means said upper end of said fence post floats above said bottom end of said fence posts;

said mesh material extending from the bottom of said fence post to an elevation above said float on said fence post; and a first cable attached to the bottom of each of said fence posts extending from end to end to said fence, whereby each of said fence posts pivots about its bottom end when horizontal force is applied to said fence post;

2. The fence according to claim 1 in which each of said floats is attached to said fence post near the mean low elevation of the surface of the water in which the fence is disposed.

3. The fence according to claim 2 further comprising a second cable attached intermediately along the length of each of said fence posts extending from end to end of said fence.

4. The fence according to claim 2 in which said mesh material extends from the bottom of said fence posts to an elevation on said fence posts above said floats and above the mean high elevation of the water in which the fence is disposed.

5. The fence according to claim 4 in which said ballast weight has a convex bottom surface.

6. The fence according to claim 4 further comprising a swivel connection means disposed between said ballast weight and the bottom of said pole by which means said pole may pivot relative to said weight.

7. The fence, according to claim 6, further comprising a cavity disposed within said ballast weight, said cavity having an opening in the top of said ballast weight, and said bottom of said pole being loosely disposed within said cavity.

8. The fence according to claim 6 in which said swivel connection means comprises a clevis and a removable clevis pin.

9. The fence according to claim 8 in which said pole is woven through openings in said mesh material.

10. The fence according to claim 9 further comprising a flexible sheath surrounding said pole, and said sheath being sewn to said mesh material.

11. The fence according to claim 4 in which said fence posts are elongated semi-rigid members.

* * * * *